US005637962A

United States Patent [19]

Prono et al.

[11] Patent Number: 5,637,962

[45] Date of Patent: Jun. 10, 1997

[54] PLASMA WAKE FIELD XUV RADIATION SOURCE

[75] Inventors: Daniel S. Prono; Michael E. Jones, both of Los Alamos, N.M.

[73] Assignee: The Regents of the University of California Office of Technology Transfer, Alameda, Calif.

[21] Appl. No.: 489,312

[22] Filed: Jun. 9, 1995

[51] Int. Cl.[6] ..... H05H 1/24

[52] U.S. Cl. ..... 315/111.21; 250/504 R; 372/5; 372/55

[58] Field of Search ..... 315/39, 111.21; 250/504 R; 372/5, 55

[56] References Cited

U.S. PATENT DOCUMENTS

| | | | |
|---|---|---|---|
| 4,344,174 | 8/1982 | Spalding et al. | 372/55 X |
| 4,715,038 | 12/1987 | Fraser et al. | 372/2 |
| 4,980,563 | 12/1990 | George et al. | 250/504 R X |
| 5,185,552 | 2/1993 | Suzuki et al. | 250/504 R X |

FOREIGN PATENT DOCUMENTS

| | | | |
|---|---|---|---|
| 1831741 | 7/1993 | Russian Federation | 372/55 |

OTHER PUBLICATIONS

Huber, Jr. et al., "Sustainer Enhancement of the VUV Fluorescence in High-Pressure Xeneon," IEEE Journal of Quantum Electronics, vol. QE-12, No. 6, Jun. 1976.

Werner et al., "Radiative and Kinetic Mechanisms in Bound-Free Excimer Lasers," IEEE Journal of Quantum Electronics, vol. QE-13, No. 9, Sep. 1977.

*Primary Examiner*—Benny Lee
*Assistant Examiner*—Justin P. Bettendorf
*Attorney, Agent, or Firm*—Ray G. Wilson

[57] ABSTRACT

A XUV radiation source uses an interaction of electron beam pulses with a gas to create a plasma radiator. A flowing gas system (10) defines a circulation loop (12) with a device (14), such as a high pressure pump or the like, for circulating the gas. A nozzle or jet (16) produces a sonic atmospheric pressure flow and increases the density of the gas for interacting with an electron beam. An electron beam is formed by a conventional radio frequency (rf) accelerator (26) and electron pulses are conventionally formed by a beam buncher (28). The rf energy is thus converted to electron beam energy, the beam energy is used to create and then thermalize an atmospheric density flowing gas to a fully ionized plasma by interaction of beam pulses with the plasma wake field, and the energetic plasma then loses energy by line radiation at XUV wavelengths Collection and focusing optics (18) are used to collect XUV radiation emitted as line radiation when the high energy density plasma loses energy that was transferred from the electron beam pulses to the plasma.

8 Claims, 8 Drawing Sheets

PLASMA WAKE FIELD XUV RADIATION SOURCE

BACKGROUND OF THE INVENTION

This invention relates to high energy density plasma systems and, more particularly, to the adaptation of electron accelerators to produce high energy plasmas for use in commercial applications. This invention was made with government support under Contract No. W-7405-ENG-36 awarded by the U.S. Department of Energy. The government has certain rights in the invention.

High energy density plasmas have broad industrial applications; for example as radiation sources with radiation in the extreme ultraviolet (XUV or soft x-ray range, i.e., wavelengths less than about 100 nm) that are used as photolithography sources in the manufacture of semiconductor integrated circuits (ICs). Other pertinent industrial and commercial applications include high temperature fusing of materials and fabrication of new materials like silica, carbon composites, and advanced ceramics. The capabilities of available imaging equipment limit component development and manufacturing. A next generation of lithography is proposed to provide ICs with features of less than 100 nm using lithography systems that produce 10 nm radiation. Current proposals are for x-ray synchrotrons to be the source of the needed 10 nm radiation.

X-ray synchrotron lithography systems, however, are large in cost and in size and are not likely to be widely available. Accordingly, there is some development in alternate devices, such as laser-produced plasma x-ray systems and z-pinch plasma sources. However, both of these systems involve high density plasmas that contact metal, causing particulate blow-off that impinges on and degrades nearby optical elements. Also, the rapid consumption of metal target foils (used in laser systems) or metal electrodes (used in z-pinch systems) inhibits or degrades continuous operation. Finally, although the output radiation power is acceptable (marginally), the power is released in very high peak-power units with rather low repetition rates (about 10 Hz for z-pinch and about 1000 Hz for laser based). As a result, quantized radiation is produced, causing IC chip manufacturers to be concerned about a lack of the pulse-to-pulse uniformity needed during a continuous chip exposure production process.

Accordingly, it is an object of the present invention to provide a high energy density plasma as a XUV radiation source as an alternate to x-ray synchrotron, laser-produced plasma, and z-pinch plasma sources.

Another object of the present invention is to provide pulsed plasma radiation sources with a high degree of pulse-to-pulse uniformity.

One other object of the present invention is to provide a plasma source capable of continuous operation through closed cycle recovery and reuse of a high pressure gas that is ionized to form the high energy density plasma.

Still another object of the present invention is to produce a high energy density plasma from a free-standing atmospheric jet rather than solid metal foils or electrodes to avoid material wear and concomitant solid particulate contaminants.

Yet another object of the present invention is to provide plasma pulses with higher irradiance than plasma pulses produced by lasers.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a gaseous plasma XUV source. A closed loop circulates a gas in proximity to a beam of electron pulses. An injector injects the electron pulses into the gas, wherein first pulses ionize the gas to create a plasma and second pulses interact with the plasma to heat the plasma to form energetic plasma, which may preferably be at atmospheric density. An optical collector receives XUV radiation as the energetic plasma radiates energy at XUV wavelengths for transmission to a receiving surface.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
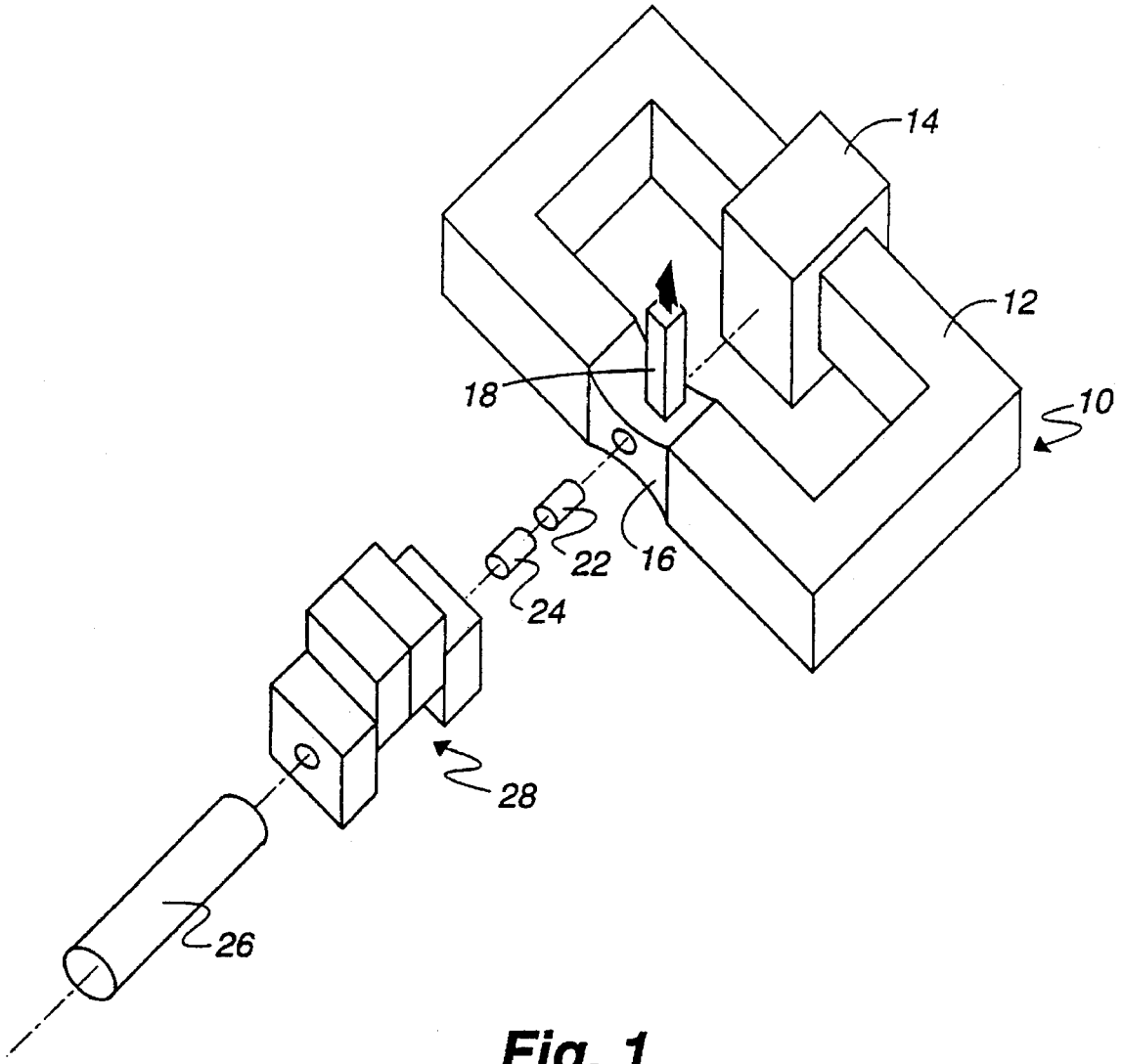
FIG. 1 is a pictorial illustration of a XUV radiation source in accordance with one embodiment of the present invention.

In accordance with the present invention, a XUV radiation source uses a novel interaction of electron beam pulses with a gas to create a plasma radiator. FIG. 1 illustrates one embodiment of the present invention. A flowing gas, such as xenon (Xe), argon (Ar, and neon (Ne), system 10 is preferably a closed loop system having a circulation loop 12 and a device 14, such as a high pressure pump or the like, for circulating the gas. Nozzle or jet 16 produces a sonic atmospheric flow and increases the density of the gas for interacting with an electron beam. Collection and focusing optics 18 are used to collect XUV radiation emitted as line radiation when the high energy density plasma loses energy that was transferred from the electron beam pulses to the plasma.

An electron beam is formed by conventional radio frequency (rf) accelerator 26 and electron pulses are conventionally formed by beam buncher 28. Generation of the requisite micro-pulse characteristics is a feature of rf electron accelerators with photocathode injectors, such as described in U.S. Pat. No. 4,715,038, incorporated herein by reference. Locating a small photocathode within a high field gradient accelerator structure enables the generation of micro-pulses with high current, low emittance, and small energy spread. Micro-pulses from a photoinjector can have a micro-pulse charge of about 5 nanocoulombs (nC) and can be compressed to have a pulse duration of a fraction of a picosecond using a magnetic buncher. To obtain such pulse compression the beam should be relativistic so as to overcome space charge forces. The photoinjector can furnish a continuous train of such micro-pulses so as to fill every rf cycle. These micro-pulses couple very efficiently to moderately high-density plasmas.

The beam pulse parameters are a feature of the present invention and are further discussed below. Electron beam pulses 22 and 24 are output from buncher 28 for input to the gas within nozzle or jet 16 for interacting with the gas to form a thermalized plasma. The rf energy is thus converted to electron beam energy, the beam energy is used to create and then thermalize an atmospheric density flowing gas to a fully ionized plasma, and the energetic plasma then loses energy by line radiation at XUV wavelengths. The XUV output is collected by optics and directed onto a suitable target (not shown), such as a photolithographic substrate. As the plasma recombines to non-ionized atomic or molecular states, it further cools against the walls of the closed cycle recirculation system 12, 14 to be re-pressurized and returned into nozzle or jet 16 be again fully ionized and thermalized by the continuous stream of electron beam micro-pulses.

Electron beam accelerator 26 and buncher 28 supply a continuous stream of rf electron beam micro-pulses to a small volume of flowing gas in nozzle or jet 16, which may be at atmospheric pressure. The first one or more micro-pulses partially ionize (~0.1%) the gas to create a filament of "target" plasma. The ionizing pulse forms a partially ionized target plasma according to the classical process:

$$\frac{\delta\eta_p}{\delta t} = \eta_B\eta_g\sigma c$$

where $\eta_p$ is the plasma density, $\eta_B$ is the electron density in the beam micro-pulse, $\eta_g$ is the circulating gas density, and $\sigma$ is the cross-section (probability of occurrence) for ionization of the gas by the beam electrons, and the velocity of the beam electrons is denoted by "c."

A following micro-pulse then heats the plasma by generating an intense plasma wake field, i.e., a separation of the plasma ions and electrons. A key innovation of the present invention is that effective generation of a plasma wake field in the target plasma created by the first micro-pulse requires high charge density micro-pulses of durations less than 1 ps. The high charge density of the micro-pulse provides efficient wake field generation and subsequent transfer of energy from the electron beam micro-pulses to the target plasma. A 1 ps time interval is the characteristic response time of the target plasma created by the first micro-pulse and strong wake field generation is accomplished when the time to form the wake field is less than the target plasma characteristic response time. An equivalent way of expressing this requirement is that the micro-pulse dimensions must be less than the target plasma characteristic wavelength. Ideally, pulses having a duration even less than 1 ps are desirable since they would efficiently couple energy to even higher target plasma density, enabling a more rapid and effective thermalization to fully ionized atmospheric density plasma. However, because of space charge repulsion forces, high charge density micro-pulses can compress to time scales somewhat under a picosecond, but have difficulty achieving times less than 0.1 ps.

The generated plasma wake field intensity as measured by its electric field, $E_p$, depends on the target plasma density ($\eta_p$) and on the total charge ($Q_p$) contained in the electron beam micro-pulse. When the micro-pulse dimensions, both radius ($a_B$) and length ($L_B$ or, equivalently, the pulse duration) are smaller than the target plasma characteristic wavelength, then $E_p$ is given by $$E_p = \frac{1}{\epsilon} Q_B k_p^2 \log(k_p a_B)$$

with $k_p=(\omega_p/c)$, $\omega_p$ is the characteristic target plasma frequency, and $\epsilon$ is the dielectric constant. Combining all physical constants and the log ($k_p a_B$) term into a single constant, K, the above equation is simply expressed as $$E_p = K\, Q_B \eta\sigma$$

which explicitly shows why both QB and ($\eta_\sigma$) should be as large as possible (yet consistent with the requirement that $L_B$ and $a_B$ be less than the target plasma characteristic wavelength). For example, if the first "ionizing" micro-pulse passes through gas flowing from nozzle or jet 16 and makes a target plasma density of $10^{16}$ $cm^{-3}$, then a second "heating" micro-pulse of ~5 nC charge and dimensions of a diameter ~100 microns and length of ~300 microns (equivalent to ~1 ps duration) will create a plasma wake field with an electric field of ~1000 MV/m. This electric field rapidly drains energy from the electron beam and causes plasma heating and thermalization, i.e., ionization to full gas density and averaging of plasma electron energy over the plasma volume.

Figure 2A:
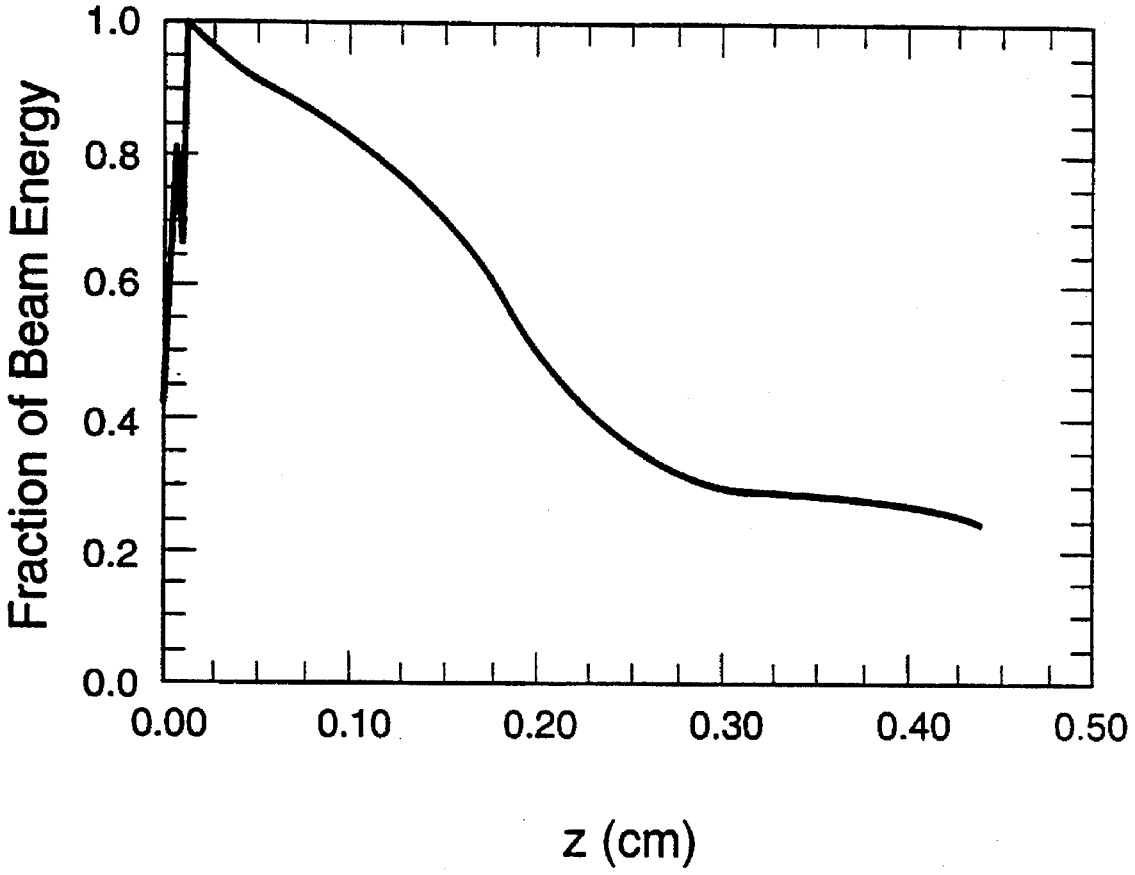
FIGS. 2A, 2B, and 2C graphically depict simulations of the interaction of electron beam pulses with a plasma.
Figure 2B:
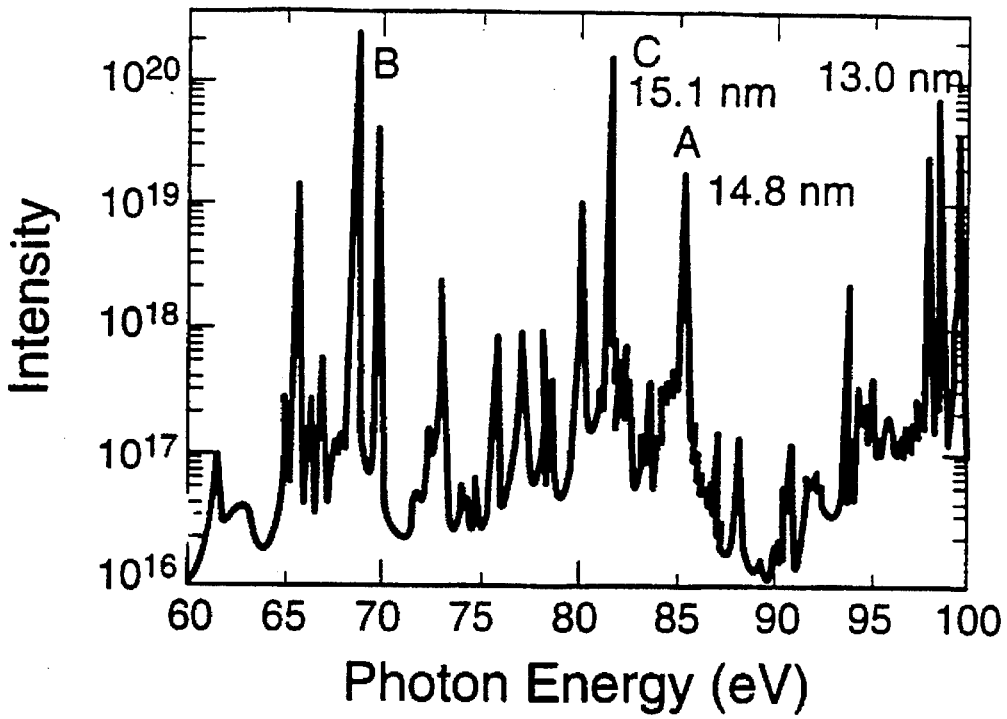
Figure 2C:
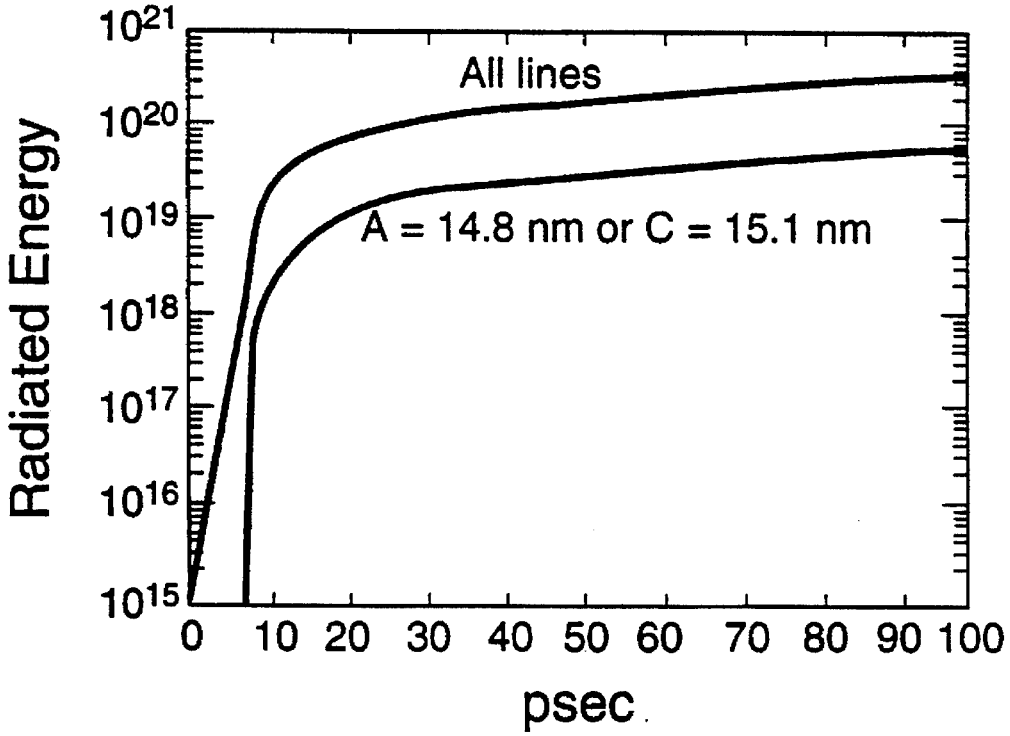

FIGS. 2A, 2B, and 2C graphically depict the simulated output from a plasma XUV radiation system having the following parameters:

| | |
|---|---|
| rf beam energy | 5 MeV |
| micro-pulse characteristics | 5 nC/micropulse, 2 pulses, 25 mJ/micro-pulse, 3 MHz rep rate |

The pulses are bunched to provide a first (ionizing) pulse having a duration of 5 ps and a second (thermalizing) pulse of 0.5 ps with a separation of 0.7 ns. Adjacent pulse pairs are separated by 333 nanosecond to permit the plasma arising from a first pair of pulses to clear the nozzle before a next pair of pulses is injected into the nozzle. Instead of waiting the 333 ns for the clearing of plasma, an alternative approach is to wait ~20 ns for the plasma to recombine from full ionization back to a 0.1% ionization state and use this as a suitable target plasma, thereby avoiding the need for the first "ionizing" micro-pulse.

FIG. 2A illustrates a simulation of how rapidly the second micro-pulse loses energy to the target plasma due to the interaction with its wake field. For the parameters set out above, the simulation predicts that, after entering the target plasma with 100% (fraction 1.0) full energy, passage through 3 mm of target plasma drains 70% of the micro-pulse energy and transfers it to the target plasma. The resulting hot and dense plasma quickly (about 100 ps) loses the energy by line radiation. The exact wavelengths of emitted line radiation depend on the target gas atomic type and on input micro-pulse beam parameters. Specific wavelengths can then be adjusted for particular applications, e.g., wavelengths for a specific photolithography requirement. FIG. 2B illustrates the wavelengths radiated by a neon plasma as the plasma loses energy. The energy of the radiated light is shown in FIG. 2C for all the emitted radiation and for specific wavelengths (14.8 nm and 15.1 nm) useful in photolithography for integrated circuit manufacture.

Experimental evidence of the interaction of an electron beam with a gas is shown in FIGS. 3A, 3B, 4A, and 4B.

Figure 3A:
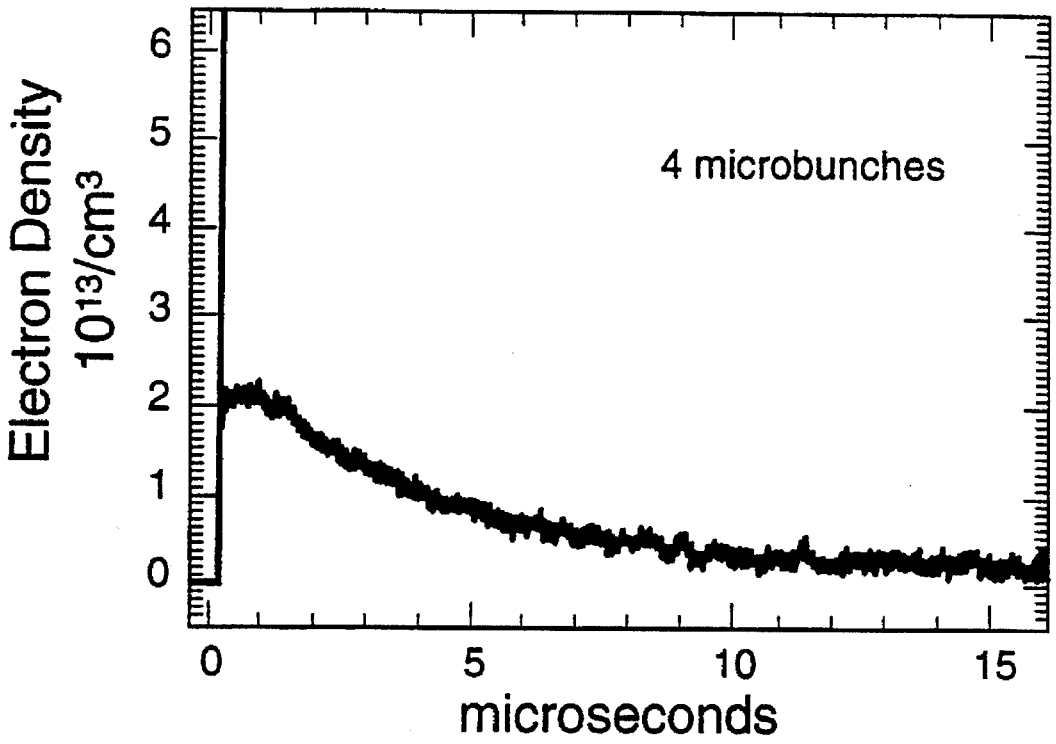
FIGS. 3A and 3B graphically depict experimental results showing plasma density after the introduction of 4 and 5 electron micro-pulses, respectively.
Figure 3B:
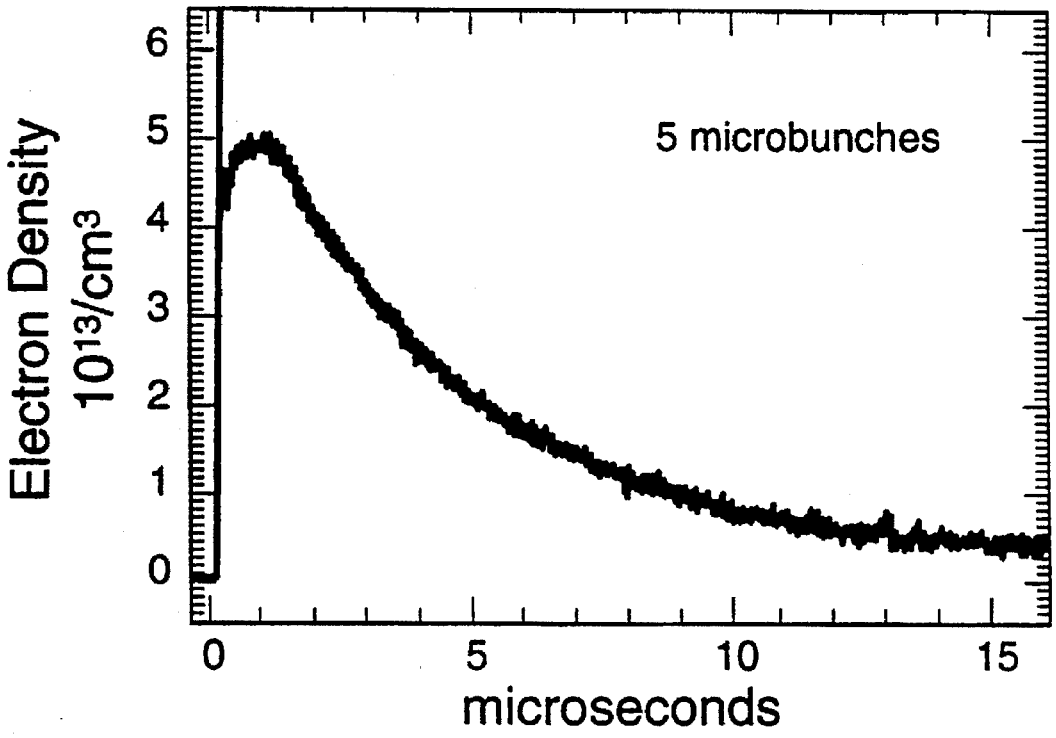

FIGS. 3A and 3B graphically show the increase of the electron density (i.e., ionization) in a gas at a pressure of about 500 mTorr with increasing deposition of electron micro-pulses into the gas. Here, each micro-pulse had a charge of about 1 nC, a 10 ps pulse duration, a beam size of 2000 microns, and first and second pulses were separated by 0.77 ns. With these parameters the wake field generation and interaction should occur at relatively low plasma density (larger beam dimensions match to lower plasma density with their longer ~$2\times10^{-3}$, which is in good agreement with the highest target plasma plasma wavelength) and should be weak (low $Q_B$and $\eta_\sigma$). As shown in FIG. 3A, four (4) micro-pulses are needed to prepare a target plasma of ~$2\times10^{13}$ $cm^{-3}$, which is in good agreement with the highest target plasma density for experimental parameters that have been used to generate wake fields. FIG. 3B illustrates that the following fifth pulse markedly increases plasma density and demonstrates significant energy loss, consistent with wake field generation by, and energy extraction from, the micro-pulse, and thermalization of the target plasma.

Figure 4A:
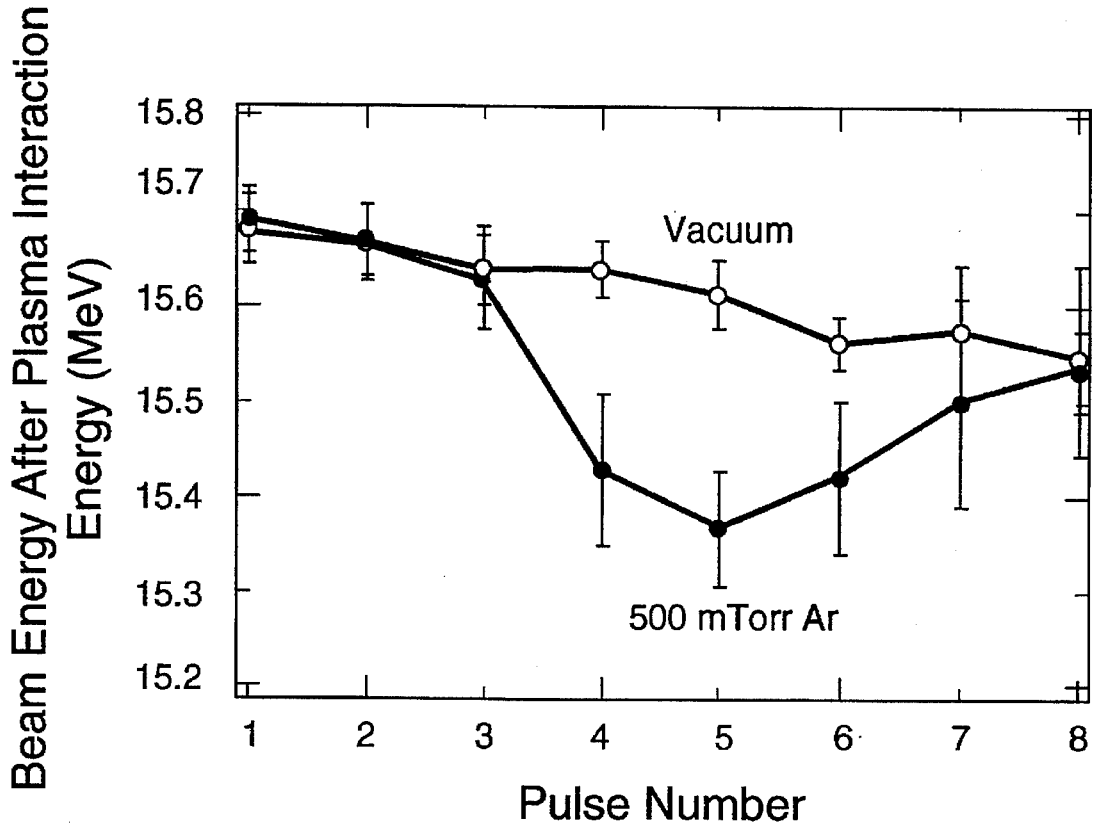
FIGS. 4A, 4B and 4C graphically depict experimental results showing energy transfer from electron beam micro-pulses to a plasma, radiation from the thermalized plasma, and beam energy loss at two different pressures of Argon.

FIG. 4A graphically depicts the extraction of energy from a beam after sufficient plasma is formed. A control experiment was done by injecting electron micro-pulses into a vacuum where there was no plasma interaction. There was no significant loss of beam energy. Argon (Ar) was then introduced at 500 mTorr. The first three micro-pulses produce too little target plasma density for interaction; the fourth and fifth pulses produce the highest target plasma density still allowed if beam dimensions are to be less than target plasma wavelength. Thus, for the fourth and fifth micro-pulses, there occurs noticeable loss of energy from the micro-pulse and transfer to the plasma. For the subsequent sixth, seventh, and eighth pulses, the micro-pulse dimensions are now larger than the target plasma characteristic wavelength due to the increasing target plasma density. Thus, generation of wake fields and concomitant micro-pulse energy loss is inhibited.

Figure 4B:
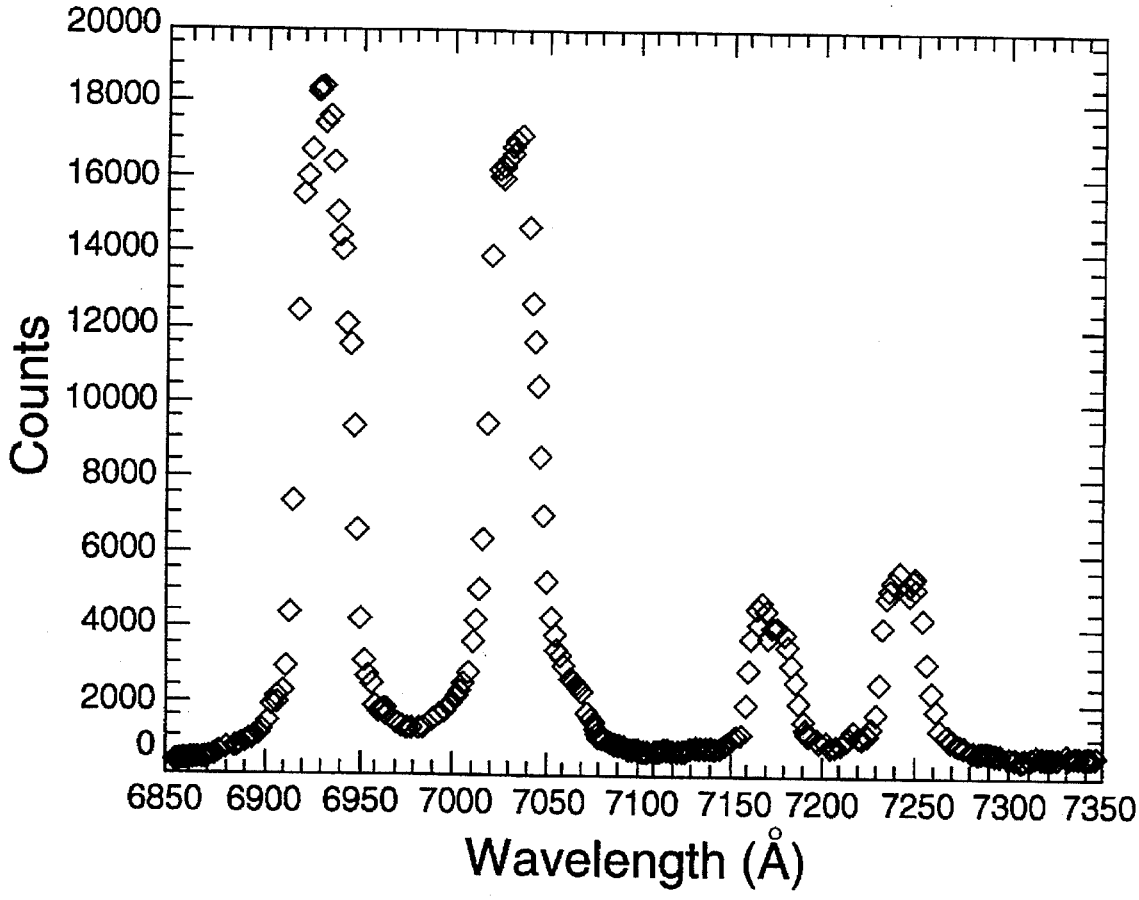

FIG. 4B shows spectroscopic data of the radiation from the thermalized plasma after the fifth micro-pulse. The line radiation peak at 693 nm and its relative intensity to the other peaks indicates a plasma temperature of ~11,000K and is consistent with the measured amount of energy extracted from the micro-pulses. Optimized parameter operation will yield higher energy density plasma and produce radiation at the desired shorter wavelengths.

Figure 4C:
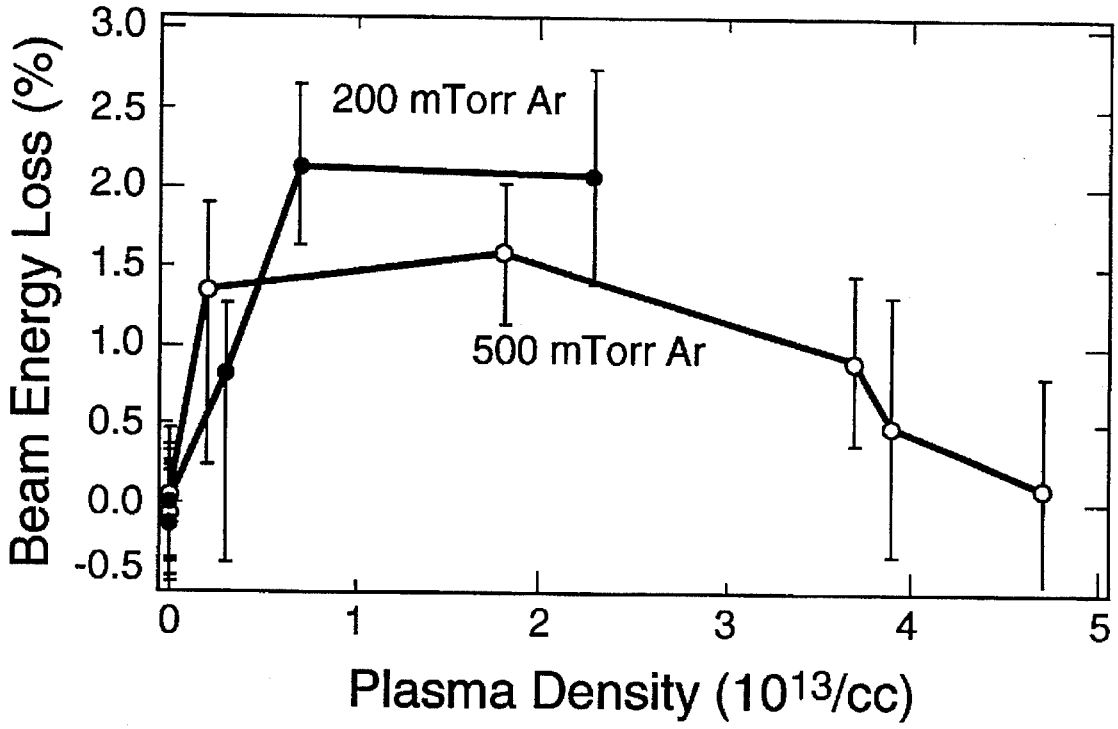

FIG. 4C shows data for beam energy loss of a series of micro-pulses when passing through two different pressures of Argon (500 and 200 mTorr). In both cases, beam energy loss increases for subsequent micro-pulses and then decreases after the fifth micro-pulse (incomplete data is available for the 200 mTorr condition). The 200 mTorr data demonstrates higher micro-pulse energy loss because, consistent with theory expectations, less scattering by the lower gas pressure and weaker wake field intensity allows the beam dimensions to maintain the small sizes requisite for wake field generation for greater distances through the target plasma. The greater distance of wake field generation offsets the lower intensity so that more total energy loss occurs.

Figure 5:
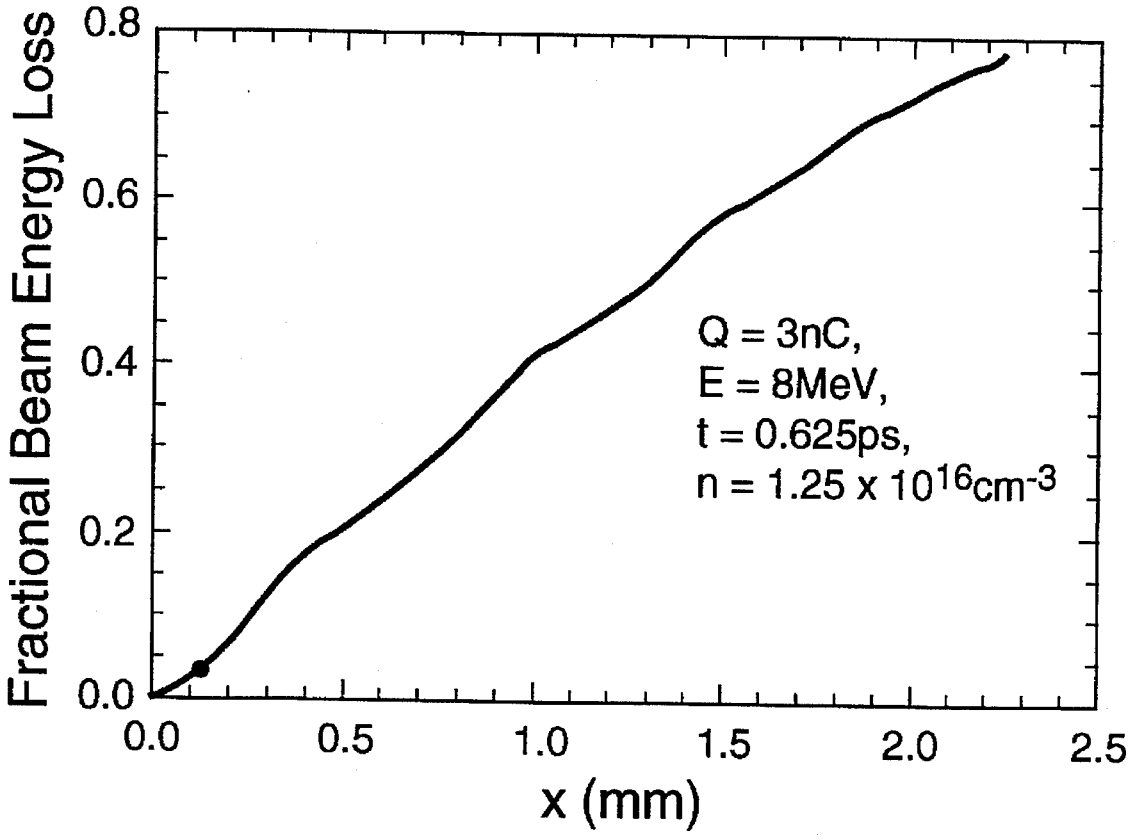
FIG. 5 graphically depicts a predicted energy deposition to a plasma.

FIG. 5 graphically depicts a simulation of fractional energy deposition in a plasma as a function of the interaction distance of the micro-pulse through the plasma. The simulation parameters are shown in Table A.

TABLE A

| | |
|---|---|
| Micro-pulse charge | Q = 3 nC |
| Plasma Electrical Field | E = 8 MeV |
| Pulse length | t = 0.625 ps |

TABLE A-continued

| | |
|---|---|
| Gas density | $\eta = 1.25 \times 10^{16}$ $cm^{-3}$ |

By way of comparison, the experimental evidence shown in FIGS. 4A, 4B, and 4C are plotted by the open circle for a micro-pulse charge of about 1 nC and a pulse length of 10 ps. Thus, significant energy deposition in the plasma is available from an optimized set of micro-pulse parameters.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for producing plasma in a gas that radiates at XUV wavelengths, comprising:

a beam of electron pulses comprising first and second pulses, wherein said second pulses have dimensions that are less than a characteristic wavelength of said plasma;

a nozzle for injecting said first and second electron pulses into said gas, wherein said first pulses partially ionize said gas to create a target plasma and said second pulses generate plasma wake fields that interact with said target plasma to fully ionize said gas to form an energetic plasma that emits said XUV radiation.

2. Apparatus according to claim 1, wherein said first and second electron pulses are temporally separated by a time shorter than a recombination time for ions forming said plasma.

3. Apparatus according to claim 2, wherein said temporal separation between said adjacent pairs of said first and second pulses is about 0.7 nanoseconds.

4. Apparatus according to claim 1, wherein said gas is selected from the group consisting of Ne, Ar, and Xe.

5. A method for generating XUV radiation from plasma formed in a gas medium, comprising:

generating a beam of electron pulses comprising first and second pulses, wherein said second pulses have dimensions that are less than a characteristic wavelength of said plasma;

directing said electron pulses into said gas, wherein said first pulses partially ionize said gas to create a target plasma and said second pulses generate plasma wake fields that interact with said target plasma to fully ionize said gas to form an energetic plasma that emits said XUV radiation.

6. A method for generating XUV radiation according claim 5, further including the step of temporally spacing said first and second electron pulses by a time shorter than a recombination time for ions forming said plasma.

7. A method for generating XUV radiation according to claim 5, wherein said temporal spacing is about 0.7 nanoseconds.

8. A method for generating XUV radiation according to claim 5, where said gas is selected from the group consisting of Ne, Ar, and Xe.

* * * * *